US005706532A

United States Patent [19]

Kettenhofen

[11] Patent Number: 5,706,532

[45] Date of Patent: Jan. 13, 1998

[54] MULTIPLE COMPARTMENT SLEEPING BAG WITH INDICIA

[75] Inventor: Robert Kettenhofen, Fall Brook, Calif.

[73] Assignee: ZBag Company, Costa Mesa, Calif.

[21] Appl. No.: 762,742

[22] Filed: Dec. 10, 1996

[51] Int. Cl.[6] ..... A47G 9/08

[52] U.S. Cl. ..... 5/413 R; 40/299; 40/630

[58] Field of Search ..... 5/413 R, 413 AM, 5/482, 658, 490; 2/69, 69.5; 40/299, 630

[56] References Cited

U.S. PATENT DOCUMENTS

| | | | |
|---|---|---|---|
| 4,095,299 | 6/1978 | Schweiso | 5/658 |
| 4,903,357 | 2/1990 | Kruchen et al. | 5/490 |
| 5,343,578 | 9/1994 | Kettenhofen | 5/413 R |
| 5,548,858 | 8/1996 | Shoa | 5/413 R |

FOREIGN PATENT DOCUMENTS

| | | | |
|---|---|---|---|
| 1302522 | 1/1973 | United Kingdom | 5/909 |

*Primary Examiner*—Alexander Grosz
*Attorney, Agent, or Firm*—Richard L. Myers

[57] ABSTRACT

A sleeping bag having multiple sleeping compartments and including a first layer, a second layer, and a third layer. A first zipper is used to removably join the first layer to the second layer, defining a first sleeping compartment. A second zipper is used to removably join the second layer to the third layer, defining a second sleeping compartment. Each of the layers provides differing insulation characteristics such that each of the sleeping compartments have different comfort characteristics. The sleeping bag may be flipped over to provide different comfort characteristics in each of the first and second sleeping compartments. An indicator for indicating the comfort characteristic of each particular sleeping compartment is attached to at least one layer, providing a simple method of determining which sleeping compartment is the preferred choice for a given environmental condition. Alternative types and configurations of indicators are also disclosed.

20 Claims, 2 Drawing Sheets

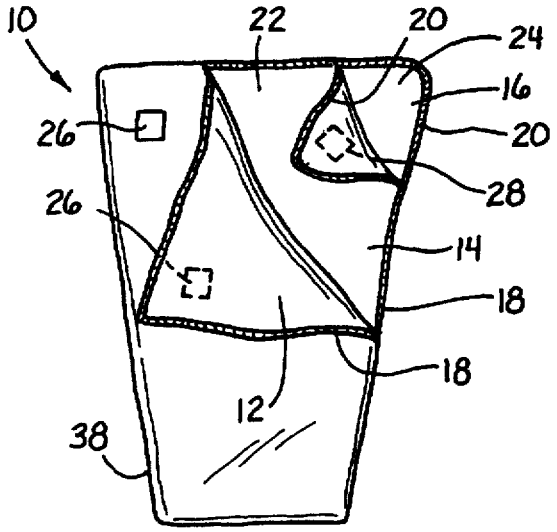
FIG. 2
FIG. 4
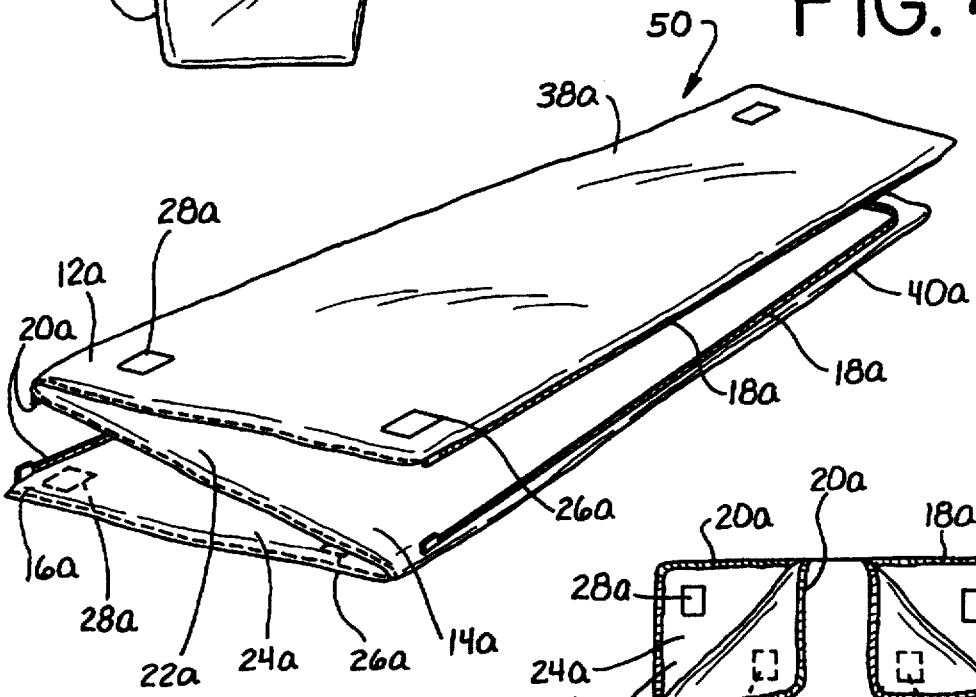
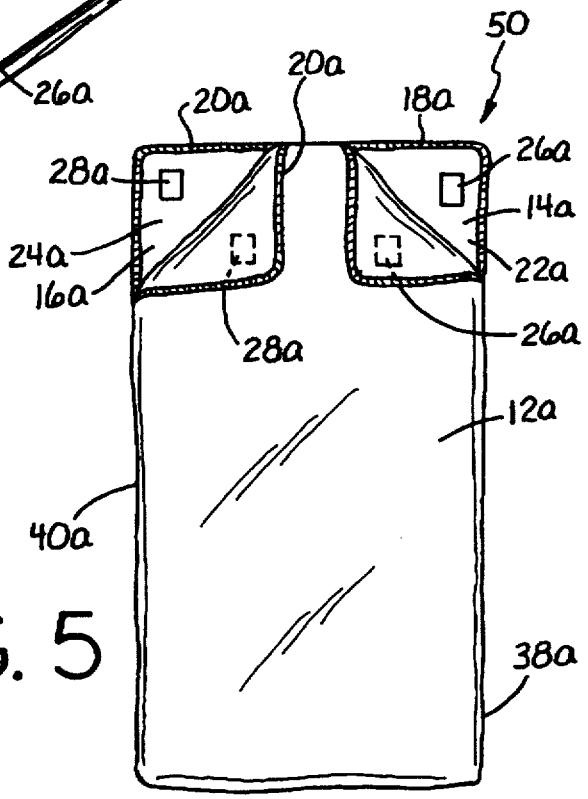
FIG. 5

MULTIPLE COMPARTMENT SLEEPING BAG WITH INDICIA

FIELD OF THE INVENTION

This invention relates generally to sleeping blankets and more particularly, to sleeping bags having multiple sleeping compartments.

BACKGROUND OF THE INVENTION

Sleeping bags have been utilized for years as general purpose sleeping equipment. More recently, multiple layer and multiple compartment sleeping bags and blankets have become available. These types of sleeping bags and blankets are generally designed for use in various environmental conditions by providing multiple sleeping layers or compartments which a user can conveniently select depending upon the climatic conditions. For example, during colder sleeping conditions, the user may select a covering of two or more blanket layers, whereas, during warmer conditions, the user may select a cover of only one layer.

U.S. Pat. No. 5,343,578, issued Sep. 6, 1996, to Kettenhofen, discloses a hinge zipper multi-entry sleeping bag. This sleeping bag provides the user with multiple sleeping compartments. However, there is no disclosed structure for facilitating the use of the various compartments or for selecting which compartment is best suited for a particular environmental conditions.

In addition to providing multiple layers, some of these sleeping bags and blankets provide layers or sleeping compartments having different insulation levels or thermal characteristics. These differing insulation layers allow a user to select from various combinations of sleeping layers or compartments, each combination of layers having a different insulation level. This allows for a greater variety of comfort levels in a given environmental condition. However, when given a choice of layers or sleeping compartments, a user must select which compartment will provide the greatest sleeping comfort or appropriate insulation level for a particular environmental circumstance. The more sleeping compartments or layers, the more choices.

It can be very difficult to select which sleeping compartment is best suited for a particular environmental or climatic condition. This problem may be compounded if the sleeping bag or blanket is only occasionally used, as when camping, or when using a sleeping bag having a multitude of layers or sleeping compartments, each having different thermal characteristics.

An inappropriate selection may lead to a very uncomfortable period of rest. Other inconveniences may include a lack of sleep and the need to move from an uncomfortable sleeping compartment into a more comfortable compartment, among other concerns.

As alternative and multi-purpose sleeping equipment, sleeping bags are commonly used on the ground or on other harsh and uneven surfaces. These surfaces often require some form of padding or insulation beneath the user in order to provide a comfortable sleeping surface. The amount of padding and insulation needed for comfort generally varies depending upon the surface and the environmental conditions.

Thus, there is a need for a sleeping bag having multiple sleeping compartments or layers which includes a device for facilitating and simplifying the selection of a desirable sleeping compartment or layers to be used. There is also a need for a sleeping bag or blanket which includes multiple layers of padded insulation and also includes a device for indicating how to select the desired level of padding. There is also a need for such devices which are simple to identify and easy to understand. There is also a need for such a sleeping bag which is inexpensive to manufacture.

SUMMARY

The present invention satisfies the need for a sleeping bag or blanket having multiple layers or sleeping compartments and includes a device for facilitating the selection of the desirable sleeping compartment by providing a sleeping bag having indicia for indicating a different comfort range for each sleeping compartment. The indicia includes a label providing information about which sleeping compartment is best suited for a particular sleeping surface and climatic conditions.

Briefly, and in general terms, the present invention is directed to a sleeping bag or blanket having multiple layers and multiple sleeping compartments. Each sleeping compartment includes an indicator for indicating the comfort characteristic or comfort range of the particular sleeping compartment. The indicator may be a label having indicia which is attached to the sleeping bag. Alternatively, the indicator may be printed directly on an associated layer or printed on a label attached to the sleeping bag. The indicator includes information and instructions about which sleeping compartment is best suited for a particular climatic condition. The indicator is generally provided on the outside layer of the particular sleeping compartment.

The present invention includes multiple compartment sleeping bags which have a first side, a second side and a first, second, and third layer. A first zipper is used to removably join the first layer to the second layer. The first and second layers define a first sleeping compartment which has a first comfort characteristic. A second zipper is used to removably join the second layer to the third layer. The second and third layers define a second sleeping compartment which has a second comfort characteristic. An indicator is attached to at least one of the layers for indicating the particular comfort characteristic of each layer or sleeping compartment. Multiple indicators may be used, one for indicating the comfort characteristic of each of the layers or sleeping compartments.

In another aspect of the present invention, the sleeping bag may also include a fourth layer and a third which has a second comfort characteristic. An indicator is attached to at least one of the layers for indicating the particular comfort characteristic of each layer or sleeping compartment. Multiple indicators may be used, one for indicating the comfort characteristic of each of the layers or sleeping compartments.

In another aspect of the present invention, the sleeping bag may also include a fourth layer and a third zipper which removably joins the fourth layer to the third layer. The third and fourth layers define a third sleeping compartment. A second indicator may be attached to the third layer to indicate the comfort characteristics of the third sleeping compartment. Each of the indicators may be a label having information about the comfort characteristic of the particular sleeping compartment given a particular climatic condition. The indicators may include instructions on how to select the appropriate sleeping compartment.

In another aspect of the present invention, at least one of the indicators includes information about padding characteristics for a particular sleeping compartment. The indicator is a label having information for facilitating the selection of a sleeping characteristics of each sleeping compartment is altered by changing how many layers are above that particular sleeping compartment. Thus, a sleeping compartment with a thin bottom and a thick top has a thick bottom and a thin top when flipped over.

An indicator or having comfort and insulation selection information is provided on both sides of each sleeping compartment to facilitate the selection of an appropriate sleeping compartment given the external conditions and the orientation of the sleeping bag.

In another embodiment of the present invention, a multiple layered sleeping bag is provided which includes a first side and a second side. The sleeping bag also includes a first layer, a second layer and a third layer. The second layer is coupled to the first layer along the first side of the sleeping bag and the third layer is coupled to the second layer along the second side. A first zipper removably joins the first layer to the second layer along the second side of the sleeping bag and defines a first sleeping compartment. A second zipper removably joins the second layer to the third layer along the first side of the sleeping bag and defines a second sleeping compartment.

An indicator is attached to the first layer to indicate the comfort characteristic of the first sleeping compartment and a second indicator is attached to the second layer to indicate the comfort characteristic of the second sleeping compartment. The indicators are generally attached adjacent to the zippers towards the upper opening of each sleeping compartment.

The invention, together with additional features and advantages thereof, may be best understood by reference to the following drawings and description where like numbers are used to designate generally like parts.

BRIEF DESCRIPTION OF THE DRAWINGS

FIG. 2 is a top view of the sleeping bag as shown in FIG. 1 showing the first layer opened to expose the first sleeping compartment and the second layer opened to expose the second sleeping compartment;

FIG. 4 is a perspective view of an alternative embodiment of a sleeping bag having the features of the present invention; and FIG. 5 is a top view of the sleeping bag as shown in FIG. 4 showing the first layer folded back to expose the first sleeping compartment and showing the first and second layers folded back to expose the second sleeping compartment.

DETAILED DESCRIPTION OF THE INVENTION

Figure 1:
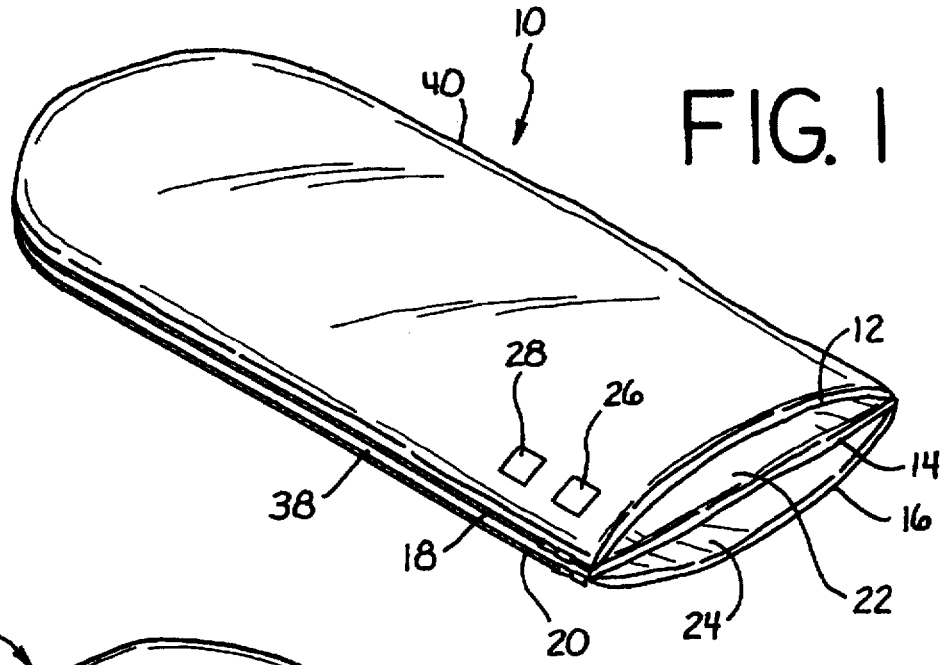
FIG. 1 is a perspective view of a sleeping bag having the features on an embodiment of the present invention.
Figure 3:
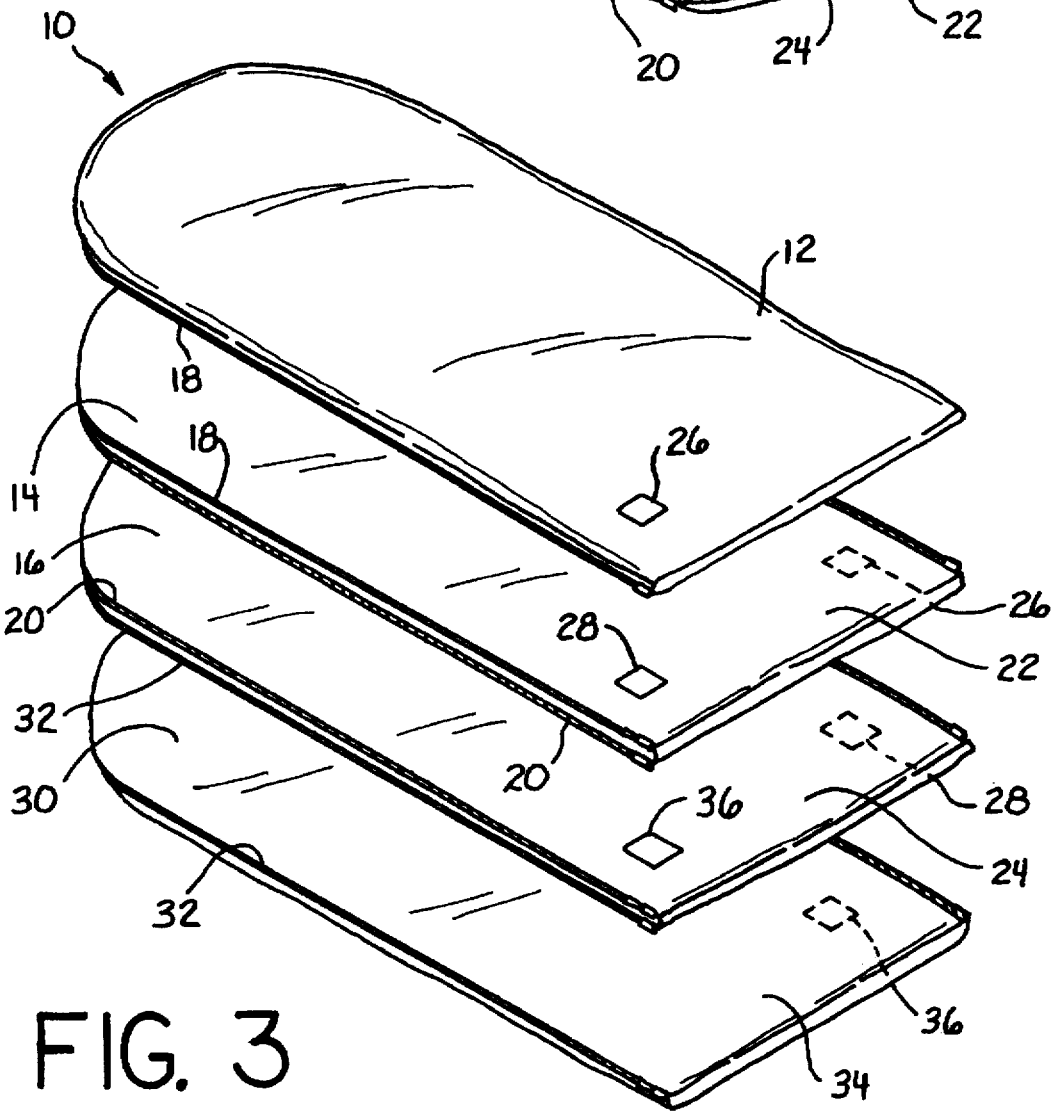
FIG. 3 is a perspective view of the sleeping bag as shown in FIG. 1 showing four layers.

An embodiment of a multiple compartment sleeping bag 10 having features of the present invention is shown in FIGS. 1–3. The sleeping bag 10 includes a first layer 12, a second layer 14, and a third layer 16. The first layer 12 may be removably joined to the second layer 14 by a first zipper 18. The second layer 14 may be removably joined to the third layer 16 by a second zipper 20. The first layer 12 and the second layer 14 generally define a first sleeping compartment 22 and the second layer 14 and the third layer 16 generally define a second sleeping compartment 24.

The first, second, and third layers 12, 14, and 16, may be formed from materials typically found in conventional sleeping bags. These materials may include insulated blankets of both natural and synthetic fibers, as well as other materials as are known in the sleeping bag and camping industry. The first layer 12 and the third layer 16 may also include materials suitable for placement on the ground or other surfaces that are uneven or have a high moisture content. These materials may also include foams, plastics, air-filled bubbles and tubes, or other materials as are known in the industry. The first layer 12 and the third layer 16 may also include a water-proof or otherwise moisture resistant outer shell for preventing the ingress of moisture into the sleeping bag 10.

The first zipper 18 and the second zipper 20 may be conventional zippers as commonly used in the sleeping bag industry. However, alternative devices may be used to attach the layers 12, 14 and 16 together. These alternative devices may be used alone or in various combinations. For example, pile and loop materials, buttons, and slide attachment devices other than zippers may be used. In the event additional layers are utilized, additional zippers or other devices as described may be provided to removably join the additional layers.

Referring now in particular to FIG. 3, sleeping bag 10 includes a fourth layer 30 which is removably attached to the third layer 16 with a third zipper 32, defining a third sleeping compartment 34. In a similar fashion, the sleeping bag 10 may be configured with any number of layers and associated sleeping compartments as desired.

For simplicity, the sleeping bag 10, as described in FIG. 1, having only two sleeping compartments 22 and 24 will be described it being understood that any number of additional layers and associated sleeping compartments may be included in such description.

Each of the first and second sleeping compartments, 22 and 24, has a particular comfort characteristic which is generally defined by the layers surrounding and creating that sleeping compartment. For example, with the first layer 12 facing upwardly, the second sleeping compartment 24 includes both the first layer 12 and the second layer 14 as layers above, and the third layer 16 below. Each comfort characteristics may include thermal insulating properties, the physical size of the sleeping compartment, the amount of padding, the layer thicknesses, and the breathability of each sleeping compartment.

Each of the layers 12, 14 and 16 may be made from similar materials and similar quantities such that each layer 12, 14 and 16 is generally similar. In this fashion, the sleeping bag 10 may be flipped over without changing the comfort characteristics of each sleeping compartment 22 and 24. In the alternative, each layer 12, 14 and 16 may comprise different materials as well as differing material quantities to achieve sleeping compartments 22 and 24, each having two different comfort characteristics.

As an example, the first layer 12 may be a thin layer of a synthetic or natural fiber insulation having a moisture-resistant outer panel. The second layer 14 may also include a layer of natural or synthetic insulation, however, the second layer 14 may be twice as thick as the first layer 12 so as to provide additional thermal insulation. Thus, each layer 12 and 14 has a different thermal insulation property. Alternatively, the second layer 14 may include any insulation having a different thermal capacity. In this way, the first sleeping compartment 22 has a first comfort characteristic which is generally defined by the insulation level of the first layer 12 covering the user (not shown). The second sleeping compartment 24 generally has a second comfort characteristic, including a thermal insulating ability defined by the combination of the first layer 12 and the second layer 14.

The sleeping bag 10 may be flipped over such that the third or otherwise bottom layer 16 is now on the top and the first layer 12 is on the bottom. In this way, the first sleeping compartment 22 is now the second sleeping compartment 24 and what was the first layer 12 for the first sleeping compartment 22 is now the third layer 16. Thus, each sleeping compartment now has two different comfort characteristics.

In the same fashion, each of the first, second, third and any other additional layer 12, 14, and 16 may be configured with material or materials having many different properties as previously described. By providing each of the layers 12, 14 and 16 with materials having different properties, and by flipping the sleeping bag 10 over, each of the sleeping compartments 22 and 24 will have two different comfort characteristics.

The first layer 12 and the third layer 16 may be fitted with a padding suitable for placing on the ground or otherwise. These outer layers 12 and 16 may also be provided with a waterproof or otherwise moisture-resistant outer shell. In this way, a user may utilize the first sleeping compartment 22 to provide a maximum padding underneath, or alternatively, when the need for insulation is light or minimal. In the alternative, the user may use the second sleeping compartment when the need for insulation is higher. The sleeping bag 10 may also be flipped over and the padding provided in the first layer 12 used.

An indicator 26 is provided on at least one of the layers 12, 14 and 16, to provide information about one of the sleeping compartments 22 and 24. Alternatively, the indicator 26 may be attached to either the first or second zipper 18 and 20. As an example, indicator 26 may be provided on the outer surface of the first layer 12. The indicator 26 may be a label designating the insulation capacity or the temperature range of the first sleeping compartment 22. Alternatively, the label 26 may provide information about the second sleeping compartment 24, or even about either of the first and second sleeping compartments 22 and 24 when the sleeping bag 10 is flipped over so that the first layer 12 is now on the ground.

In addition to the first indicator 26, a second indicator 28 may be provided to yield information about the sleeping compartments 22 and 24. In this configuration, the first indicator may be provided on the first layer 12 to provide information about the first sleeping compartment 22, and the second indicator 28 may be provided adjacent the first indicator 26 to provide information about the second sleeping compartment 24. Alternatively, the second indicator 28 may be located on the second layer 14 to provide information about the second sleeping compartment 24. In another configuration, indicator 26 may be a tag attached to the first zipper 18 and the second indicator 28 may be attached to the second zipper 20.

The indicators 26 and 28 may preferably be labels or tags which are permanently fixed to the sleeping bag 10. In a preferred embodiment, the indicator 26 is a label associating a temperature range with a particular sleeping compartment. In this embodiment, the temperature range may indicate an outside temperature range for which the particular sleeping compartment is suitably designed and will provide general comfort. Indicators 26 and 28 may also include information on the level of padding, moisture resistance or similar.

In another aspect of the present invention, indicator 28 includes a temperature measuring device 28 for indicating the temperature outside the sleeping compartments 22 and 24. In this way, a user may select the desired sleeping compartment based on the indicated temperature. The temperature measuring device 28 may preferably include a strip thermometer attached to the first layer 12.

Referring now to FIGS. 4–5, a second alternative embodiment of a sleeping bag constructed in accordance with the principles of the present invention is shown. In this embodiment, like features to those of the previously described embodiment are designated by like reference numerals, succeeded by the letter "a". The multilayered sleeping bag 50 generally has a first side **38*a* and a second side 40*a* and includes a first layer 12*a*, a second layer 14*a* and a third layer 16*a***. However, any number of layers may be included as previously described.

The second layer **14*a* may be coupled to the first layer along the first side 38*a* of the sleeping bag 50, and the third layer 16*a* may be coupled to the second layer 14*a* along said second side 40*a*. Coupling is preferably accomplished using a generally continuous piece of flexible material which is also used as the outer panels of each of the layers 12*a*, 14*a* and 16*a***. However, a specific hinge piece such as a flexible plastic, cloth or other member may also be used.

A first zipper **18*a* is used to removably join the first layer 12*a* to the second layer 14*a* along the second side 40*a*. The joined first and second layers 12*a* and 14*a*, define a first sleeping compartment 22*a*. A second zipper 20*a* is used to removably join the second layer 14*a* to the third layer 16*a* along the first side 38*a*. The joined second and third layers 14*a* and 16*a* define a second sleeping compartment 24*a***.

An indicator **26*a* is attached to at least one of the layers 12*a*, 14*a* and 16*a*. Alternatively, the indicator 26*a* may be attached to at least one of the first and second zippers 18*a* and 24*a*. The indicator 26*a* preferably includes information about the comfort characteristics of each sleeping compartment 22*a* and 24*a* as described for the previous embodiments. The indicator 26*a*** may also include instruction on how to select the appropriate sleeping compartment based on particular environmental conditions.

Referring now in particular to FIG. 5, an indicator 26 may be provided on the first layer **12*a*. The indicator 26 is preferably attached next to the first side 38*a*, adjacent to the first zipper 18*a*. The indicator 26*a* is preferably a label as described above and provides information particular to the first sleeping compartment 22*a*. This is particularly useful since the first zipper 18*a* opens to this first sleeping compartment 22*a*. Alternatively, the indicator 26*a* may be a tag attached to the first zipper 18*a***.

A second indicator 28 may be also be attached to the first layer **12*a*. This indicator 28*a* is preferably attached next to the second side 40*a* adjacent to the second zipper 20*a*. Alternatively, the second indicator 28*a* may be a tag attached to the second zipper 20*a*. The indicator 28*a* is preferably a label as described above and provides information particular to the first sleeping compartment 24*a*. This is particularly useful since the second zipper 20*a* opens to the second sleeping compartment 24*a*. Additional indicators 26*a* and 28*a* may be provided on the second layer 14*a* to generally repeat and confirm the information given on the first layer 12*a***.

A first indicator **26*a* and a second indicator 28*a* may also be provided on the third or otherwise bottom layer 16*a* such that information about each particular sleeping compartment 22*a* and 24*a* is provided when the sleeping bag 50** is flipped over.

As is generally obvious, many different types and configurations of indicators **26*a* and 28*a* may be included to provide information about the general or particular comfort characteristics of the sleeping bag 50 or about the appropriate selection of a particular sleeping compartment 22***a* and 24*a*. This includes the many different alternative available configurations or attachment locations on the sleeping bag 50. It shall be understood that while this invention has been described with respect of various specific examples and embodiments, it is to be understood that the invention is not limited thereto and that it can be variously practiced within the scope of the following claims.

What is claimed is:

1. A multiple layered sleeping bag having a first side and a second side comprising;

a first layer;

a second layer;

a third layer;

a first zipper removably joining said first layer and said second layer and defining a first sleeping compartment having a first insulating characteristic;

a second zipper removably joining said second layer and said third layer and defining a second sleeping compartment having a second insulating characteristic different than the first insulating characteristics; and a first indicator located in proximity to the first sleeping compartment, the first indicator providing an indication of the first insulating characteristics and the suitability of the first sleeping compartment climatic conditions; and a second indicator located in proximity to the second sleeping compartment, the second indicator providing an indication of the second insulating characteristics and the suitability of the second sleeping compartment for second climatic conditions different than the first climatic conditions.

2. The sleeping bag as recited in claim 1 wherein:

said first indicator comprises a first label indicating an estimated temperature range for said first sleeping compartment; and said second indicator comprises a second label indicating an estimated temperature range for said second sleeping compartment.

3. The sleeping bag as recited in claim 2 wherein:

said first label is attached to one of said first layer and second layer; and said second label is attached to one of said second layer and third layer.

4. The sleeping bag as recited in claim 1 wherein:

said first indicator comprises a tag attached to said first zipper; and said second indicator comprises a tag attached to said second zipper.

5. The sleeping bag as recited in claim 1 wherein said first indicator comprises a temperature measuring device.

6. The sleeping bag as recited in claim 1 wherein said first layer has a first thermal insulation property, said second layer has a second thermal insulation property and said third layer has a third thermal insulation property.

7. The sleeping bag as recited in claim 1 wherein said first thermal characteristic is substantially equivalent to said second thermal characteristic.

8. The sleeping bag as recited in claim 1 and further comprising:

a fourth layer; and a third zipper removably joining said third layer and said fourth layer to define a third sleeping compartment having a third comfort characteristic.

9. The sleeping bag as recited in claim 1 wherein said first zipper is compatible and interconnectable with said second zipper.

10. A multiple layered sleeping bag having a first side and a second side comprising:

a first layer;

a second layer coupled to said first layer along said first side of said bag;

a third layer coupled to said second layer along said second side of said bag;

a first zipper removably joining the first layer to the second layer along the second side of said bag, said first zipper defining a first sleeping compartment having first insulating characteristics;

a second zipper removably joining the second layer to the third layer along the first side of said bag, said second zipper defining a second sleeping compartment having second insulating characteristics different then the first insulating characteristics; and an indicator attached to at least one of said layers for indicating at least one of said first and second insulating characteristics of the associated first and second sleeping compartments.

11. The sleeping bag as recited in claim 10 wherein said indicator is attached to said first layer.

12. The sleeping bag as recited in claim 11 wherein said indicator comprises a tag having indicia and being attached to said first zipper.

13. The sleeping bag as recited in claim 11 and further comprising a second indicator attached to said first layer.

14. The sleeping bag as recited in claim 12 wherein said second indicator comprises a tag attached to said second zipper.

15. The sleeping bag as recited in claim 10 and further comprising:

a fourth layer coupled to said third layer along said first side of said bag; and a third zipper removably joining the third layer to the fourth layer along the second side of said bag, said third zipper defining a third sleeping compartment.

16. The sleeping bag as recited in claim 10 wherein said indicator is a label indicating a thermal insulation property for at least one of said sleeping compartments.

17. The sleeping bag as recited in claim 10 wherein said indicator is a label indicating a padding characteristic for at least one of said sleeping compartments.

18. A multiple compartment sleeping bag comprising:

a first sleeping compartment having a first layer, a second layer and a first zipper removably joining said first layer and said second layer, said first sleeping compartment having first insulating characteristic;

a second sleeping compartment having a third layer and a second zipper for removably joining said third layer and said second layer, said second sleeping compartment having second insulating characteristics different than the first sleeping characteristics; and an indicator attached to said first layer adjacent to said first zipper for indicating said first insulating characteristics.

19. The sleeping bag as recited in claim 18 and further comprising a second indicator attached to said first layer adjacent to said second zipper for indicating said second comfort characteristic.

20. The sleeping bag as recited in claim 18 wherein said indicator is a label.

* * * * *